US010016018B2

(12) United States Patent
Haselaars

(10) Patent No.: US 10,016,018 B2
(45) Date of Patent: Jul. 10, 2018

(54) INSOLE FOR HIGH-HEELED SHOE

(71) Applicant: Ellen Haselaars, Halen (BE)

(72) Inventor: Ellen Haselaars, Halen (BE)

( * ) Notice: Subject to any disclaimer, the term of this patent is extended or adjusted under 35 U.S.C. 154(b) by 51 days.

(21) Appl. No.: 15/022,678

(22) PCT Filed: Aug. 29, 2014

(86) PCT No.: PCT/BE2014/000041
§ 371 (c)(1),
(2) Date: Mar. 17, 2016

(87) PCT Pub. No.: WO2015/039192
PCT Pub. Date: Mar. 26, 2015

(65) Prior Publication Data

US 2016/0227879 A1 Aug. 11, 2016

(30) Foreign Application Priority Data

Sep. 18, 2013 (BE) ..... 2013/0623
Dec. 23, 2013 (BE) ..... 2013/0872

(51) Int. Cl.
*A43B 7/14* (2006.01)
*A43B 17/02* (2006.01)
*A43B 13/37* (2006.01)
*A43B 13/14* (2006.01)
*A43B 17/14* (2006.01)

(52) U.S. Cl.
CPC ..... *A43B 17/023* (2013.01); *A43B 7/141* (2013.01); *A43B 7/142* (2013.01); *A43B 7/144* (2013.01); *A43B 7/1405* (2013.01); *A43B 7/1445* (2013.01); *A43B 13/14* (2013.01); *A43B 13/37* (2013.01); *A43B 17/14* (2013.01)

(58) Field of Classification Search
CPC ..... A43B 7/1405; A43B 7/142; A43B 7/1425; A43B 7/144; A43B 7/1445; A43B 7/30; A43B 13/37
USPC ..... 36/43, 44, 24.5, 173, 174, 180, 80
See application file for complete search history.

(56) References Cited

U.S. PATENT DOCUMENTS 1,746,002 A * 2/1930 Lobel ..... A43B 7/14 36/180
1,976,441 A * 10/1934 Feldman ..... A43B 7/142 36/173
2,157,026 A * 5/1939 Sochor ..... A43B 7/142 36/178
2,238,366 A * 4/1941 Leydecker ..... A43B 7/14 36/180

(Continued)

FOREIGN PATENT DOCUMENTS

FR 1209020 2/1960

*Primary Examiner* — Marie Bays
(74) *Attorney, Agent, or Firm* — Marcus C. Dawes; Daniel L. Dawes

(57) ABSTRACT

Insole (14) for a high-heeled shoe (4), wherein the insole (14) has proximally a first zone (1) provided for the purpose of supporting a heel of a foot and further has distally of the first zone a second zone (2) which is provided for the purpose of supporting a middle part of the foot, wherein the second zone is provided with a teardrop-shaped raised area (12) positioned such that a tail of the teardrop shape extends in proximal direction, wherein the first zone (1) has a thickness which increases gradually in distal direction such that a wedge shape is obtained which extends over at least sixty percent of the first zone (1).

15 Claims, 3 Drawing Sheets

(56) References Cited

U.S. PATENT DOCUMENTS 2,246,944 A * 6/1941 Larkin ..... A43B 7/141 36/180
2,567,028 A * 9/1951 Rapisarda ..... A43B 7/1415 36/173
2,729,900 A 1/1956 MacCarone
2,769,253 A * 11/1956 Whitman ..... A43B 7/142 36/176
2,990,629 A * 7/1961 McLaughlin ..... A43B 23/22 36/173
4,333,472 A * 6/1982 Tager ..... A43B 7/1425 36/140
5,226,247 A 7/1993 Ambrose
8,256,142 B2 * 9/2012 Igdari ..... A43B 7/142 36/102
9,060,563 B2 * 6/2015 Tsai ..... A43B 7/1415
2004/0211086 A1 * 10/2004 Dananberg ..... A43B 7/14 36/11.5
2005/0050771 A1 * 3/2005 Dananberg ..... A43B 7/14 36/43
2008/0098621 A1 * 5/2008 Tzeng ..... A43B 7/1425 36/44
2009/0255148 A1 * 10/2009 Dananberg ..... A43B 7/14 36/44
2010/0269371 A1 * 10/2010 Gray ..... A43B 7/141 36/43
2014/0250722 A1 * 9/2014 Lin ..... A43B 7/142 36/44
2014/0259755 A1 * 9/2014 Tsai ..... A43B 7/1415 36/43
2015/0335102 A1 * 11/2015 Jackson ..... A43D 86/00 12/142 R
2016/0044990 A1 * 2/2016 Georgeson ..... A43B 23/28 36/43
2016/0095382 A1 * 4/2016 Takahashi ..... A43B 17/00 36/44

* cited by examiner

INSOLE FOR HIGH-HEELED SHOE

The present invention relates to an insole for a high-heeled shoe. The invention further relates to a high-heeled shoe comprising an insole according to the invention.

High-heeled shoes have been popular among women for many years because such shoes generally have a positive effect on appearance. Such shoes have further long formed part of popular fashion and style trends. For the above reasons women have in the past always accepted the drawbacks of such shoes. It is also likely that women will continue to wear high-heeled shoes in the future.

A drawback of high-heeled shoes is that they are not very comfortable and are often even deemed unhealthy. A high-heeled shoe is defined here as a shoe wherein, when the shoe rests on a flat ground surface and supports a foot, the heel of the foot is a minimum of four centimeters higher than the toes of the foot. Because the heel of the foot is positioned higher than the toes of the foot, the foot tends to slide downward. In addition, the weight of the person wearing the high-heeled shoes will typically be supported by the forefoot, while in the case of a conventional shoe the weight is distributed more uniformly over heel, midfoot and forefoot. The result hereof is that a high-heeled shoe provides considerably less support than a conventional shoe (because the greater part of the weight comes to lie on the forefoot) and that a high-heeled shoe feels considerably less comfortable than a conventional shoe.

Different solutions are proposed in the prior art for increasing the wearer comfort of a high-heeled shoe. US 2004/0211086 is deemed here the closest prior art for the present invention. An insole is described here for a high-heeled shoe, wherein the insole has a first zone proximally which is provided for the purpose of supporting a heel of a foot, and distally of the first zone further has a second zone provided for the purpose of supporting a middle part of the foot, wherein the second zone is provided with a teardrop-shaped raised area positioned such that a tail of the teardrop shape extends in proximal direction. Providing the teardrop-shaped raised area under the middle part of the foot imparts extra support to the middle part of the foot, and some of the force which is normally applied to the forefoot is borne by the midfoot. The support provided by a high-heeled shoe is hereby increased.

US 2004/0211086 further describes a crescent-shaped raised area at the distal end of the first zone, which crescent-shaped raised area forms a ridge which prevents downward sliding of the heel. Some of the weight which would normally be applied to the forefoot is hereby absorbed by the crescent-shaped raised area at the distal end of the heel. A better support distribution is hereby also achieved, whereby the foot is better supported in the high-heeled shoe and whereby the forefoot is slightly relieved of pressure.

A drawback of the known insole is that the wearer comfort is not optimal.

It is an object of the invention to provide an insole for a high-heeled shoe, wherein both the wearer comfort and the support are improved.

The invention provides for this purpose an insole for a high-heeled shoe, wherein the insole has proximally a first zone provided for the purpose of supporting a heel of a foot and further has distally of the first zone a second zone which is provided for the purpose of supporting a middle part of the foot, wherein the second zone is provided with a teardrop-shaped raised area positioned such that a tail of the teardrop shape extends in proximal direction, characterized in that the first zone has a thickness which increases gradually in distal direction such that a wedge shape is obtained which extends over at least sixty percent of the first zone.

By providing a wedge-shaped raised area under the heel, wherein the thickness increases in distal direction, the surface on which the heel rests is tilted to a more horizontal direction. Depending on the height of the heel, this surface typically lies at an appreciable oblique angle (steep) relative to the horizontal plane. The heel of the foot resting thereon will therefore undergo less downward sliding because the surface on which the heel rests is less steep (less oblique angle). In the insole according to the invention the weight which normally comes to lie more on the forefoot is in this way at least partially displaced to the heel of the foot. This effect is obtained by providing a wedge shape which extends over at least sixty percent of the first zone. Because the wedge shape extends over at least sixty percent of the first zone, the raised area will not be perceived as a ridge by a wearer. Tests have shown that providing a wedge-shaped raised area which gradually increases over sixty percent of the first zone is perceived by a wearer as being very comfortable, while the support for the foot in the high-heeled shoe improves considerably.

A synergistic effect further occurs between the teardrop-shaped raised area in the second zone and the wedge-shaped raised area in the first zone. In addition to having the positive effect of increasing the vertical support of the midfoot, the teardrop-shaped raised area in the second zone will also have a negative effect because the foot is pushed into a greater angle of inclination (away from the insole) by the teardrop-shaped raised area. The wedge-shaped raised area in the first zone of the insole according to the invention surprisingly lessens the adverse effect of the teardrop-shaped raised area in the second zone because the heel of the foot is supported at a smaller angle with the horizontal plane. The force necessary to compensate for the reduced adverse effect (pushing into greater angle of inclination) is further spread over substantially the whole surface of the first zone. A wearer will no longer be able to feel this force. The insole according to the invention will hereby be perceived as being appreciably more comfortable when compared to a prior art insole.

The thickness of the first zone preferably increases in constant manner so that the upper side of the wedge shape is substantially flat. The constant increase in the thickness results in a wedge shape with a flat upper side. The wedge-shaped insole reduces the angle of the surface on which the heel rests relative to the horizontal plane. By allowing the thickness of the wedge shape to increase in constant manner, this angle of the surface on which the heel rests is reduced by a constant factor. Downward sliding of the heel from this surface will as a result be reduced by a constant factor over the whole surface area of the wedge shape. This constant factor forms an important aspect in increasing the wearer comfort of the high-heeled shoe provided with an insole according to the invention.

The wedge shape preferably extends over at least 70%, preferably at least 80%, more preferably at least 90%, most preferably over substantially the whole of the first zone. By distributing the wedge shape over substantially the whole first zone the increased resistance to downward sliding (which results from the smaller angle relative to the horizontal plane on which the heel rests) is distributed over substantially the whole first zone. Increasing the surface area which is adapted to prevent downward sliding will further increase comfort.

The thickness in the first zone preferably increases by a minimum of 1.5 mm, more preferably by a minimum of 2.5 mm, most preferably by a minimum of 4 mm. The thickness in the first zone more preferably increases by a maximum of 7 mm, preferably a maximum of 6 mm, more preferably by a maximum of 5 mm. Tests have shown that an increase in thickness of 2 mm has a positive effect on the wearer comfort and support of the high-heeled shoe. A raised area of 3 mm increases the wearer comfort even more, while a raised area of a minimum of 4 mm substantially maximizes the wearer comfort and the support. A raised area of a maximum of 7 mm is further acceptable for increasing the wearer comfort of a high-heeled shoe, although the raised area is preferably a maximum of 5 mm, whereby a substantially optimal wearer comfort is achieved.

The increased thickness of the insole preferably decreases at the distal end of the first zone, at a transition to the second zone, over a distance of a maximum of 7 mm, preferably a maximum of 5 mm, more preferably a maximum of 3 mm. Having the increased thickness decrease over a relatively short distance creates a steep transition between the first zone and the second zone. This steep transition has a dual effect. This steep transition is on the one hand found to enhance the wearer comfort for a user. The steep transition on the other hand allows the insole to bend between the first and the second zone (directly behind the decreased thickness). This bending of the insole may be necessary when a high-heeled shoe has on the inner side an angle between the zone for supporting the heel and the zone for supporting the midfoot. The insole can follow this angle.

The teardrop shape preferably has at a highest point a raised area of a minimum of 3 mm, preferably a minimum of 4 mm, more preferably a minimum of 5 mm, most preferably a minimum of 6 mm, this raised area tapering in the direction of the tail of the teardrop shape. Tests have shown that a raised area of a minimum of 3 mm as highest point of the teardrop shape already has a noticeably positive effect on the wearer comfort for a wearer of the high-heeled shoe. An optimal comfort is experienced by a wearer of the high-heeled shoe, and the midfoot is maximally supported, when the teardrop shape has a raised area of a minimum of 6 mm at a highest point.

When the insole supports the foot, the highest point of the teardrop shape is preferably positioned under metatarsal 3 of the foot adjacently of and proximally relative to the metatarsal heads of the foot, and wherein the tail of the teardrop shape extends in the direction of the calcaneus of the foot. Tests have shown that such a position and orientation of the teardrop shape result in an optimal wearer comfort and support for the foot.

When the insole supports the foot, the teardrop-shaped raised area preferably extends in transverse direction from metatarsal 2 up to metatarsal 4 of the foot. The teardrop-shaped raised area does not hereby cover the whole width of the foot, but the teardrop-shaped raised area is positioned only under a middle part of the foot. Tests have shown that a teardrop-shaped raised area extending in the transverse direction under the foot in such manner supports the foot in balanced manner and hereby does not have an adverse effect on the balance of the foot, while the foot is still better supported in a middle zone.

The insole preferably has a further raised area at the position of a medial side of a second zone such that, when the insole supports the foot, the further raised area is provided in order to support a medial arch of the foot. Support of the medial arch is known for the purpose of increasing the wearer comfort of a shoe. However, in combination with the wedge-shaped raised area in the first zone and with the teardrop-shaped raised area in the second zone a synergistic effect occurs, wherein the support of the medial arch not only increases comfort but also substantially counteracts downward sliding of the foot. Owing to the placing of the further raised area under the medial arch of the foot some of the downward sliding force of the foot is counteracted by the further raised area. The further raised area however influences the points of support of the foot, whereby the foot will also lean more heavily on the teardrop-shaped raised area and the downward sliding is thus further reduced by the teardrop-shaped raised area. The foot will also rest more on the heel part, whereby the downward sliding is also better counteracted by the heel part. The wedge-shaped raised area in the first zone, the teardrop-shaped raised area in the second zone and the further raised area under the medial arch in this way co-act in synergistic manner in order to counteract downward sliding of the foot in the high-heeled shoe with the insole according to the invention, whereby the support is improved and comfort is thus improved.

The further raised area preferably has a further highest point which, when the foot supports the insole, is located at the position of a sustentaculum tali of the foot. Such a highest point can be determined by determining an average height of the sustentaculum tali of feet of a group of people who preferably have roughly the same shoe size. Such a height is found to be optimal for supporting the medial arch.

The insole preferably has a substantially uniform basic thickness of a minimum of 1 mm, and the raised areas are formed relative to the basic thickness of the insole. Forming the insole with a basic thickness and forming the raised areas relative to the basic thickness enable simple manufacture of the insole. This also allows the insole to be sold as a separate item. The insole can hereby be used as a shoe insert in a high-heeled shoe. This insole can however also be integrated as integral part of a high-heeled shoe, wherein the insole is provided fixedly in the shoe.

The insole preferably further comprises a third zone distally of the second zone for the purpose of supporting the forefoot. Because a third zone is provided the insole runs as one whole from the heel all the way up to the forefoot, whereby the foot is supported in continuous manner. Because the insole is typically also formed from a single material, the foot will also be supported by only one material and the foot will only experience a single contact sensation.

The insole is preferably at least partially manufactured from a material chosen from polyurethane, ethylene vinyl acetate (EVA) and urethane foam. These materials are found to be sufficiently hard to impart good support to the foot and to be sufficiently soft to avoid pressure points and to absorb shocks.

The invention further relates to a high-heeled shoe comprising an insole according to the invention. The high-heeled shoe will hereby have the above described advantages and effects.

The shoe preferably has a platform at the position of the forefoot such that the angle of inclination of the foot in the shoe is determined by the height of the heel minus the height of the platform. Downward sliding of the foot is in this way reduced by reducing the angle of inclination at which the foot lies by raising the forefoot. Providing a platform under the forefoot will therefore appreciably increase the wearer comfort of the high-heeled shoe.

The invention will now be further described on the basis of an exemplary embodiment shown in the drawing.

In the drawing.

The same or similar elements are designated in the drawing with the same reference numerals.

Figure 1:
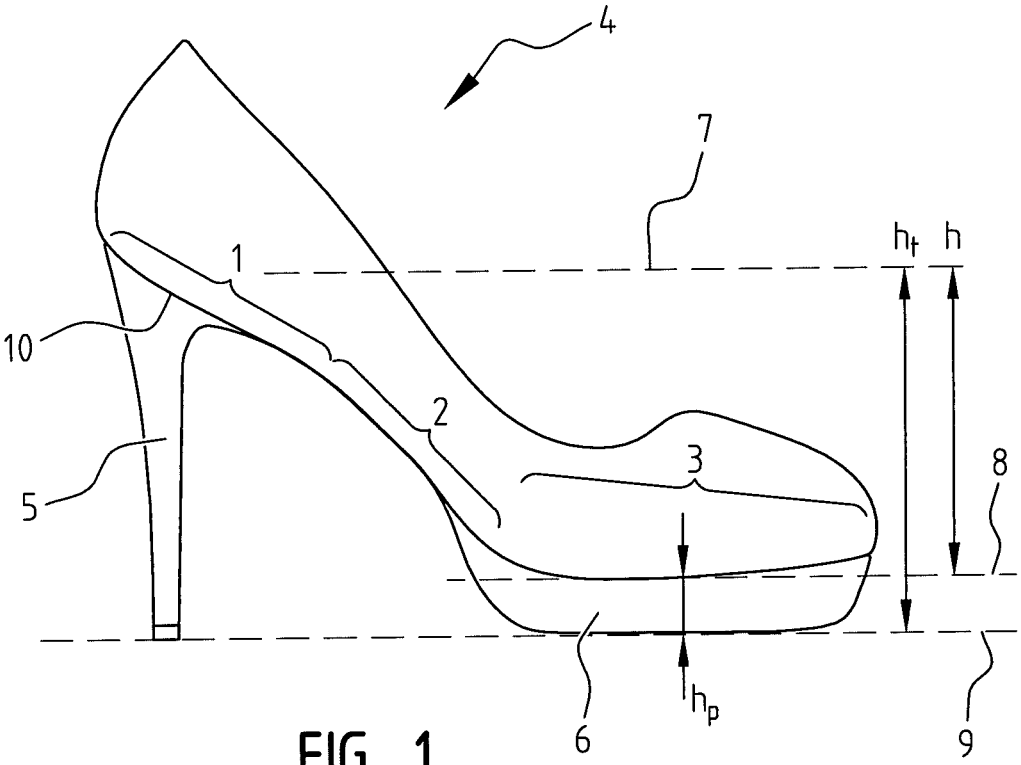
FIG. 1 is a side view of a high-heeled shoe.

FIG. 1 shows an embodiment of a high-heeled shoe 4. Situated in high-heeled shoe 4 is a first zone 1 which is formed to support a heel part of a foot, a second zone 2 provided to support a middle part of the foot and a third zone 3 provided to support the forefoot. A high-heeled shoe is defined as a shoe wherein the average height 7 at which the heel is supported in first zone 1 lies a minimum of 3 cm higher than the average height 8 at which the forefoot is supported in third zone 3. The height difference between heel and forefoot is designated in the figure with h. While the invention is can be applied to a high-heeled shoe wherein the heel has a height such as to have a height difference h of at least 3 cm, it will be apparent that the advantages and effects of the invention will increase greatly when the height difference h increases. The invention is thus ideally applied in a high-heeled shoe wherein the height difference h is a minimum of 4 cm, preferably a minimum of 5 cm, more preferably a minimum of 6 cm.

FIG. 1 shows a further aspect of the invention, wherein the average angle of inclination of surface 10 (this surface 10 being a combination of first zone 1, second zone 2 and third zone 3) on which the foot rests is reduced relative to the horizontal plane 9 without reducing the height of heel 5. This is achieved by providing a platform 6 under the forefoot of shoe 4. Platform 6 has a height $h_p$, while heel 5 has a height $h_t$. In a high-heeled shoe wherein a platform is not provided under the forefoot, the height of the heel $h_t$ will be roughly equal to the height difference h between the heel and the forefoot. This height difference h determines the average angle of inclination of surface 10 on which the foot rests relative to horizontal plane 9. Providing a platform 6 with a height $h_p$ makes the height difference h equal to the total height $h_t$ of heel 5 minus the platform height $h_p$ ($h=h_t-h_p$). By reducing the height difference h the average angle with the horizontal plane of surface 10 on which the foot rests will also decrease. Reducing this angle will reduce the downward sliding force (which is proportional to the size of the angle) to which a foot resting on the inclining surface 10 is subjected (wherein the foot supports the weight of a person when shoe 4 stands on a ground surface 9).

Figure 2:
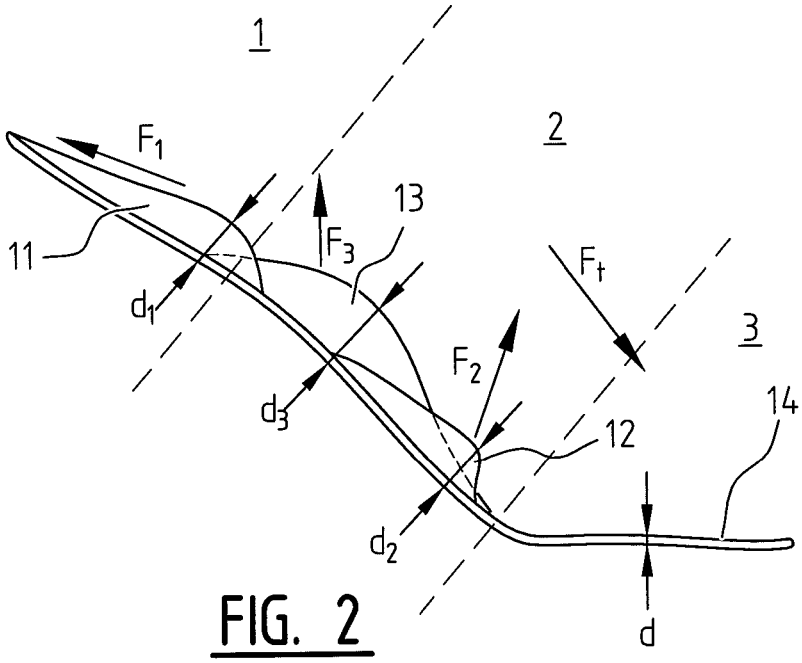
FIG. 2 is a side view of an insole according to a preferred embodiment of the invention.
Figure 3:
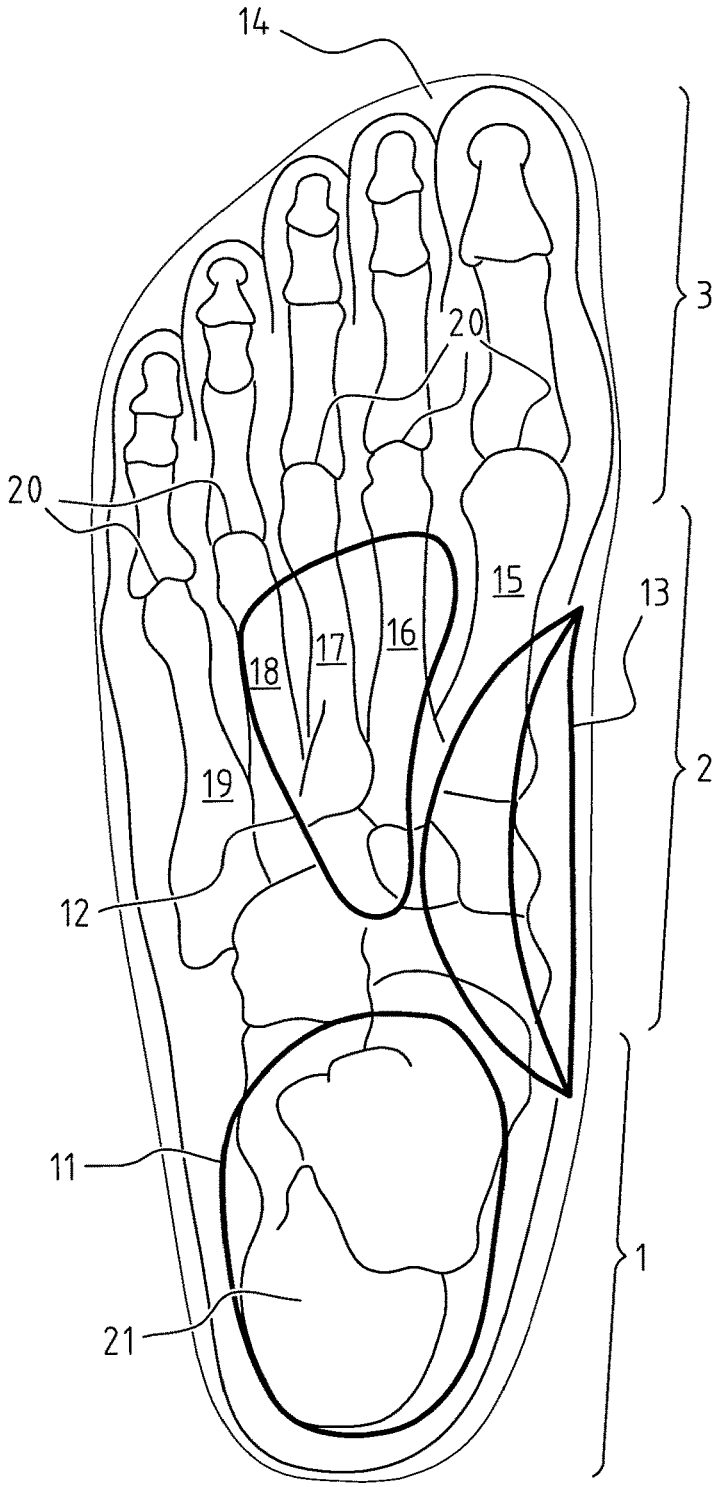
FIG. 3 is a top view of the insole of FIG. 2 which shows the foot bones of the foot resting on the insole.
Figure 4:
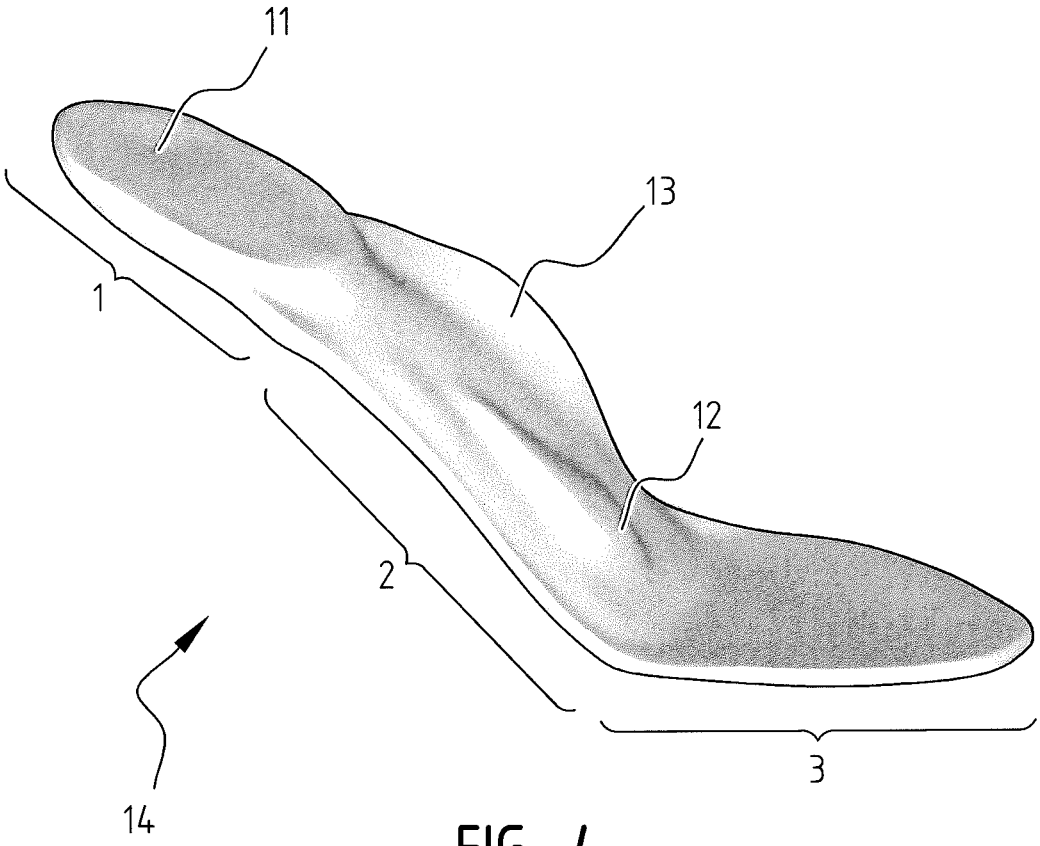
FIG. 4 is a perspective view of an insole according to a preferred embodiment of the invention.

FIG. 2 shows a side view of insole 14 according to the invention which is provided for the purpose of considerably improving the wearer comfort and the support in a high-heeled shoe. Just as the inner surface 10 of the shoe (on which the foot rests), insole 14 has a first zone 1 for supporting the heel of the foot, a second zone 2 for supporting a middle part of the foot and a third zone 3 for supporting the forefoot. According to the preferred embodiment of FIG. 2, insole 14 comprises three raised areas 11, 12 and 13. Provided in first zone 1 is a wedge-shaped raised area 11 for supporting the heel, provided in second zone 2 is a teardrop-shaped raised area 12 for supporting the midfoot, and likewise provided in second zone 2 is a further raised area 13 for supporting the medial arch of the foot. Each of the raised areas will be described in further detail below. Because no specific raised area is provided at the position of forefoot 3 of insole 14, this zone 3 makes no appreciable contribution toward improving the support for the foot. This third zone 3 does however contribute toward increase in the wearer comfort since the forming of the whole insole 14 (first, second and third zones) integrally and from one material is perceived by a wearer as being comfortable. While FIG. 2 shows a side view of the insole and the raised areas provided thereon, FIG. 3 shows insole 14 and raised areas 11, 12 and 13 in top view. FIG. 4 shows a perspective view of an insole with raised areas. FIG. 3 shows the bones of a foot resting on insole 14 so as to thereby indicate the correct positioning of a preferred position of the raised areas.

The wedge-shaped raised area 11 extends in a first zone 1 of insole 14. This first zone 1 is placed under the heel of a foot when the insole supports the foot. First zone 1 lies adjacently of the proximal end of insole 14. The terms proximal and distal define an anatomical direction. An anatomical direction typically originates from the centre of the body of a person. Here the term proximal designates the direction toward the centre of the body, while the term distal designates the direction away from the centre of the body. The foot of the body is thus connected to the distal end of the leg. The heel of the foot is located at the proximal end of the foot, while the toes are located at the distal end of the foot. In the description of the present invention the terms proximal and distal are used in similar manner to describe the insole.

The wedge-shaped raised area 11 extends over a minimum of 60 percent of the surface area of the first zone, preferably a minimum of 70 percent of the first zone, preferably a minimum of 80 percent of the first zone, more preferably 90 percent of the first zone and most preferably over the whole first zone. The wedge-shaped raised area 11 is formed by having the thickness (basic thickness) of insole 14 increase gradually and preferably constantly from a minimum thickness at the proximal end of first zone 1 to a maximum thickness at the distal end of the first zone. The thickness hereby increases in distal direction. The thickness preferably increases in constant manner, whereby a substantially flat upper surface is obtained. This substantially flat upper surface of the wedge-shaped raised area 11 has an average angle with the ground surface which is smaller than the average angle between the lower surface of wedge shape 11 and the ground surface. Because the angle is smaller, the downward sliding force $F_t$ to which a foot is subjected when the foot rests on the insole will be smaller at the position of the wedge-shaped raised area 11 (compared to the same situation without the wedge-shaped raised area). It can therefore be stated that the wedge-shaped raised area 11 applies a force $F_1$ to the foot which counteracts the downward sliding force $F_t$.

According to an embodiment which is not shown in the figures, first zone 1 is concave, wherein the convex underside of the heel is reflected in the concave shape of first zone 1. Such a concave first zone can still be provided with a wedge-shaped raised area in order to reduce the average angle of inclination of the concave shape relative to the ground surface. The thickness of such a wedge-shaped raised area can further still increase in constant manner, although this will not have the result, as described above, that the upper side of the first zone is flat but will have the result that the concave shape in the first zone is integrally rotated to a concave form which has a flatter position relative to the horizontal plane but which has the same shape. Such an embodiment is still deemed an insole with a wedge-shaped raised area, wherein the thickness increases gradually and constantly in distal direction, despite the upper side of the insole not being flat.

Because the wedge-shaped raised area extends under substantially the whole heel of the foot, the downward sliding force $F_t$ will be reduced over the whole surface by force $F_t$, whereby a better support distribution is obtained of the weight of the person wearing the high-heeled shoe with insole according to the invention. At the distal end of first zone 1 the increased raised area 11 preferably decreases sharply, back to the basic thickness of insole 14. A transition to second zone 2 is hereby created in insole 14. A sharp decrease in thickness has no adverse effect on the comfort for the wearer because the foot hardly rests on the insole distally of and adjacently of the heel. The sharp decrease in thickness further has the advantage that the insole is easily foldable. It will be apparent that the increased thickness considerably increases the resistance to folding. Owing to the sharp decrease in the thickness the insole will fold easily distally of the first zone where the thickness has decreased. A sharp decrease is defined as a decrease over a horizontal distance (or distance in the plane of the insole) of a maximum of 7 mm, preferably a maximum of 5 mm, more preferably a maximum of 3 mm.

In the wedge-shaped raised area 11 the thickness of the insole increases by a minimum of 2 mm, preferably a minimum of 3 mm, more preferably a minimum of 4 mm. In addition, the thickness increases by a maximum of 7 mm, preferably by a maximum of 6 mm, more preferably by a maximum of 5 mm. In an embodiment wherein insole 14 has a basic thickness d of 2 mm, the first zone will have an overall thickness of 2 mm (being the basic thickness) at the position of the proximal end thereof, while the overall thickness at the position of the distal end of the first zone is for instance 7.3 mm. This thickness at the position of the distal end of the first zone is shown in FIG. 2 with designation $d_1$. $d_1$ is equal here to the basic thickness d plus the raised area of wedge shape 11.

The teardrop-shaped raised area 12 is provided in a second zone 2 of insole 14. Second zone 2 is the part of the insole extending from the distal end of the calcaneus 21 up to the metatarsal heads 20. Second zone 2 hereby supports the metatarsals of the foot, being first metatarsal 15, second metatarsal 16, third metatarsal 17, fourth metatarsal 18 and fifth metatarsal 19. The teardrop-shaped raised area 12 has a tail 22 extending in the direction of calcaneus 21. Lying opposite the tail end of the teardrop shape is the convex end of the teardrop shape which is located at the position of a distal end of second zone 2. The teardrop-shaped raised area 12 has a highest point 23 where the raised area is at a maximum, which highest point is typically located at the convex end of the teardrop shape. At this highest point 23 the teardrop-shaped raised area 12 preferably has a raised area of a minimum of 3 mm, more preferably a minimum of 4 mm and most preferably a minimum of 5 mm. At this highest point 23 the raised area is preferably smaller than 8 mm, more preferably smaller than 7 mm, most preferably smaller than 6 mm. In the case of an insole 14 with a thickness d of 1.5 mm the teardrop-shaped raised area is preferably formed such that a thickness $d_2$ of 7.7 mm is measured at the highest point. It will hereby be apparent that the above described raised area is relative to the thickness of the insole such that the overall measured thickness $d_2$ is equal to the thickness d of the insole (the basic thickness) plus the raised area.

The thickness of the teardrop-shaped raised area 12 preferably tapers in the direction of the tail of the teardrop-shaped raised area 12. The thickness more preferably tapers in a constant manner (in a straight line) between the highest point 23 of the teardrop-shaped raised area 12 and an end of the tail 22 of the teardrop-shaped raised area. Tests have shown that such a thickness of the teardrop-shaped raised area which tapers toward the heel provides an optimal wearer comfort while improving the support for the midfoot.

The teardrop-shaped raised area 12 is positioned substantially centrally as seen in the transverse direction. That is to say that, when insole 14 supports a foot, the teardrop-shaped raised area is placed with its highest point 23 under third metatarsal 17. The teardrop-shaped raised area 12 further extends under second metatarsal 16 and fourth metatarsal 18. The teardrop-shaped raised area 12 is preferably formed such that the thickness decreases in transverse direction from the highest point 23 such that the thickness has decreased under first metatarsal 15 and under fifth metatarsal 19. First metatarsal 15 and fifth metatarsal 19 will hereby not be directly affected by the teardrop-shaped raised area 12, and the stability of the foot will not be adversely affected. The tail end of the teardrop-shaped raised area 12 is located at the position of the distal end of the calcaneus, i.e. at a maximum of 20 mm from the distal end of the calcaneus, preferably at a maximum of 15 mm from the distal end of the calcaneus. The convex end of the teardrop-shaped raised area 12 located at the distal end of second zone 2 is preferably situated proximally relative to and adjacently of metatarsal heads 20 when the insole supports a foot. Because the teardrop-shaped raised area extends under second metatarsal 16, third metatarsal 17 and fourth metatarsal 18, the second metatarsal head, the third metatarsal head and fourth metatarsal head will be relieved of pressure.

The teardrop-shaped raised area 12 supports the midfoot in upward direction owing to the tail shape. Because the raised area is placed on an inclining surface the foot is however also pushed away from this surface. The resulting force to which the foot is subjected as a result of the teardrop-shaped raised area 12 is shown in FIG. 2 with arrow $F_2$. This force $F_2$ has an upward component (perpendicularly upward) which enhances the support for the foot. Force $F_2$ however also has a horizontal component in the direction of the forefoot which in itself detrimental to the support for the foot. When the teardrop-shaped raised area 12 is considered as individual element, this horizontal adverse effect hereby reduces the positive effect of the upward component of force $F_2$. A synergistic effect however occurs in combination with the wedge-shaped raised area 11. This is because force $F_1$ has a component which counteracts force $F_t$ and has a horizontal component in the direction of the heel part. This horizontal component in the direction of the heel part largely neutralizes the horizontal component of force $F_2$ in the direction of the forefoot, whereby the adverse effect is fully compensated at the position of the heel of the foot. Only the positive component of the wedge-shaped raised area 11 and the positive component of the teardrop-shaped raised area 12 hereby remain, and the support for the foot is considerably improved.

Second zone 2 preferably comprises a further raised area 13 for supporting the medial arch of the foot. Support of the medial arch of the foot is known to the skilled person, and the shape and position of this further raised area 13 will therefore not be described in detail. In the present invention, which is specifically aimed at supporting a foot in a high-heeled shoe, several specific choices have been made in respect of this further raised area 13 which will be further elucidated hereinbelow. The further raised area 13 thus preferably has a thickness such that the highest point of raised area 13 is located at the position of the sustentaculum tali of the foot when the insole supports the foot. It will be apparent here to the skilled person that the height of the further raised area will not be at the position of the sustentaculum tali for every individual person, but that the further raised area is formed such that the highest point is located at the position where the sustentaculum tali may on average be expected.

The further raised area 13 is preferably at least partially formed from a material which is harder than the material of insole 14. The further raised area hereby undergoes less compression by the weight of the foot than if the further raised area were formed from the same material as the insole. The lesser compression has the result that the medial arch is better supported, whereby the support for the foot is further improved. Despite the fact that the placing of the further raised area has considerable advantages in supporting of the foot, it is not deemed essential according to the invention because the insole according to the invention can be applied in open shoes (for instance a high-heeled sandal). Open shoes have no side walls at the position of the middle part of the insole. The further raised area typically rests against a side wall of the shoe, which has aesthetic drawbacks in the case of an open shoe. The further raised area is therefore omitted in the case of an open shoe, while the further raised area preferably does form part of insole 14 for closed shoes. The height of the further raised area can be determined here by the height of the side wall of the shoe if the side wall of the shoe is lower than the height of the sustentaculum tali of the foot. An improved support is thus obtained without having aesthetic drawbacks. In summary, it can be stated that for a high-heeled shoe, wherein the shoe has predetermined dimensions, an insole is preferably provided which has a teardrop-shaped raised area, a wedge-shaped raised area and a further raised area for supporting the medial arch, wherein the further raised area is formed such that the highest point located at the position of the sustentaculum tali, which height is reduced on the basis of the dimensions of the shoe such that the further raised area does not extend above the edge of the shoe. In accordance with such a formulation, the further raised area will always have a height such that the highest point is located at the position of the sustentaculum tali of the foot unless the edge of the shoe does not allow this, in which case the further raised area will have a smaller height.

A third zone 3 of insole 14 is preferably situated distally of second zone 2. Cushions can be provided in this third zone 3 for the purpose of supporting the metatarsal heads. A planar raised area (not shown) can further be provided at the position of a proximal and outer part (being at the position of an outer side of the foot when the foot is placed on the insole) of third zone 3. This planar raised area, which is present on the outer side but not on the inner side of third zone 3, will correct the foot as it tips forward, and thereby at least partially correct a so-called pronation (generally known abnormal movement during forward tilting of the foot while walking). The skilled person is familiar with raised areas for correcting pronation, and such a raised area is preferably present in the insole of the invention in order to correct the planar flexion of the foot. Because the skilled person is familiar with such raised areas, the precise shape and height of the raised area are not discussed in detail. Insole 14 is preferably formed from a material chosen from polyurethane, ethylene vinyl acetate (EVA) or urethane foam. A specific example of urethane foam is the material marketed by Rogers Corporation under the name Poron®. Tests have shown here that Poron® shock pad foam is optimal for forming an insole according to the invention. This urethane foam has a density of 242 kg/m$^3$ (measured in accordance with the method ASTM D 3574-95 test A). The insole is further preferably formed from a material with a hardness of 10+/−5 shore A. The further raised area 13 can be at least partially formed here from a material with a hardness of 55+/−10 shore A.

According to an alternative embodiment, the insole is manufactured from two layers. A first layer comprises the raised areas and substantially defines the shape of the insole. A second layer with a substantially constant thickness is placed on the first layer. The second layer forms the top layer of the insole which comes into contact with the foot and which will thereby determine the aesthetic and tactile properties of the insole. The first layer is preferably manufactured here from EVA, and the second layer is preferably manufactured from urethane foam such as Poron®. The first layer preferably has a hardness of 30+/−10 shore A. The second layer preferably has a hardness which is less than the hardness of the first layer. The specific combination of EVA and urethane foam has particular advantages, i.e. the EVA has the property that it can (permanently) shape itself to the form of the foot. The urethane foam has the property that it always returns to its original shape. The EVA hereby provides a shoe insole which adapts to the foot, while the urethane foam will absorb shocks. A comfortable insole is obtained with the combination of a harder first layer with raised areas and a softer second layer of constant thickness. It is further possible to place on the first and second layer a third finishing layer which, if the third layer is present, will determine the aesthetic and tactile properties of the insole instead of the second layer.

In this alternative embodiment with two layers the first layer is preferably formed so as to extend under only a part of third zone 3, and so not under the whole third zone. The first layer will particularly comprise only the raised areas. Third zone 3 does not here comprise a raised area, at least at the position of its distal and inner end (being at the position of an inner side of the foot when the foot is placed on the insole). It is stated in this context that the proximal and outer ends of third zone 3 can be provided with a planar raised area in order to correct pronation of the foot. The second layer preferably does extend over the whole first, second and third zone of insole 14. The second layer hereby extends further than the first layer. The insole will hereby feel continuous, while the insole has nevertheless been manufactured with a minimal thickness (since the first layer does not extend over the whole insole). By keeping the thickness of the insole minimal, particularly at the position of the forefoot, space is created in a front part of the shoe for the toes (or the available space is utilized optimally), whereby the wearer comfort is considerably increased.

FIG. 4 shows a perspective view of an insole 14 with a first zone 1 comprising a wedge-shaped raised area 11, a second zone 2 with the teardrop-shaped raised area 12 and the further raised area 13 for supporting the medial arch, and a third zone 3. Insole 14 here has a basic thickness d and the raised areas 11, 12, 13 are formed relative to the basic thickness. Insole 14 is further preferably formed so as to fit onto inner surface 10 of shoe 4.

It will be apparent to the skilled person that the above description describes only a few preferred embodiments of the invention, and that the invention is not limited to the described embodiments. The different technical features described above in respect of the insole, the shoe and the combination thereof can be freely combined and modified by the skilled person without departing from the scope of protection, which is defined solely in the claims.

The invention claimed is:

1. Insole for a high-heeled shoe, wherein the insole has proximally a first zone provided for the purpose of supporting a heel of a foot and further has distally of the first zone a second zone which is provided for the purpose of supporting a middle part of the foot, wherein the second zone is provided with a teardrop-shaped raised area positioned such that a tail of the teardrop shape extends in proximal direction, wherein the first zone has a thickness which increases gradually in a distal direction such that both a wedge shape which extends over at least sixty percent of the first zone and a proximal portion of a further raised area which is configured to support a medial arch of the foot are obtained, the wedge shape and the proximal portion of the further raised area being disposed laterally adjacent to each other along a common longitudinal axis within the first zone.

2. Insole as claimed in claim 1, wherein the thickness of the first zone increases in constant manner so that the upper surface of the wedge shape is substantially flat.

3. Insole as claimed in claim 1, wherein the wedge shape extends over at least 70% of the first zone.

4. Insole as claimed in claim 1, wherein the thickness in the first zone increases by a minimum of 1.5 mm.

5. Insole as claimed in claim 1, wherein the increased thickness of the insole decreases at a distal end of the first zone, at a transition to the second zone, over a distance of a maximum of 7 mm.

6. Insole as claimed in claim 1, wherein the teardrop shape has at a highest point a raised area of a minimum of 3 mm, this raised area tapering in the direction of the tail of the teardrop shape.

7. Insole as claimed in claim 6, wherein, when the insole supports the foot, the highest point of the teardrop shape is configured to be positioned under metatarsal 3 of the foot adjacently of and proximally relative to the metatarsal heads of the foot, and wherein the tail of the teardrop shape is configured to extend in the direction of the calcaneus of the foot.

8. Insole as claimed in claim 1, wherein, when the insole supports the foot, wherein the teardrop-shaped raised area is configured to extend in transverse direction from metatarsal 2 up to metatarsal 4 of the foot.

9. Insole as claimed in claim 1, wherein the further raised area is further disposed at a medial side of the second zone such that, when the insole supports the foot, the further raised area provides support to the medial arch of the foot within the second zone.

10. Insole as claimed in claim 9, wherein the further raised area has a further highest point which, when the foot supports the insole, is configured to be located at the position of a sustentaculum tali of the foot.

11. Insole as claimed in claim 1, wherein the insole has a substantially uniform basic thickness of a minimum of 1 mm, and wherein said raised areas are formed relative to the basic thickness of the insole.

12. Insole as claimed in claim 1, wherein the insole further comprises a third zone distally of the second zone for the purpose of supporting the forefoot.

13. Insole as claimed in claim 1, wherein the insole is at least partially manufactured from a material chosen from polyurethane, ethylene vinyl acetate and urethane foam.

14. High-heeled shoe comprising an insole as claimed in claim 1.

15. High-heeled shoe as claimed in claim 14, wherein the shoe has a platform at the position of the forefoot such that the angle of inclination of the foot in the shoe is determined by the height of the heel minus the height of the platform.

* * * * *